US012575654B2

(12) United States Patent
Bohman et al.

(10) Patent No.: US 12,575,654 B2
(45) Date of Patent: Mar. 17, 2026

(54) PROTECTIVE CASE WITH GRIP AND STAND

(71) Applicant: Otter Products, LLC, Fort Collins, CO (US)

(72) Inventors: David J. Bohman, Fort Collins, CO (US); Jonathan B. Rayeski, Fort Collins, CO (US)

(73) Assignee: Otter Products, LLC, Fort Collins, CO (US)

( * ) Notice: Subject to any disclaimer, the term of this patent is extended or adjusted under 35 U.S.C. 154(b) by 298 days.

(21) Appl. No.: 18/386,659

(22) Filed: Nov. 3, 2023

(65) Prior Publication Data

US 2024/0148120 A1 May 9, 2024

Related U.S. Application Data

(60) Provisional application No. 63/423,893, filed on Nov. 9, 2022.

(51) Int. Cl.
*H04M 1/04* (2006.01)
*A45C 11/18* (2006.01)
(Continued)

(52) U.S. Cl.
CPC ..... *A45C 15/00* (2013.01); *A45C 11/182* (2013.01); *A45C 13/005* (2013.01); *A45F 5/00* (2013.01); *A45C 11/001* (2025.01); *A45C 11/002* (2025.01); *A45C 11/003* (2025.01); *A45C 2200/15* (2013.01); *A45F 2005/002* (2013.01); *A45F 2005/006* (2013.01);
(Continued)

(58) Field of Classification Search
CPC ..... H04M 1/04; F16M 13/04; F16M 13/00; F16M 13/022; F16M 11/10; A45F 5/1516; A45F 5/1525; A45F 5/1508; A45F 2005/006
USPC ..... 248/688; 361/679.59
See application file for complete search history.

(56) References Cited

U.S. PATENT DOCUMENTS 1,495,752 A 5/1924 La Rue
2,060,394 A * 11/1936 Hiering ..... A45C 13/04 29/444
(Continued)

FOREIGN PATENT DOCUMENTS

CN 202488509 U 10/2012
FR 935529 A 6/1948
(Continued)

OTHER PUBLICATIONS

U.S. Appl. No. 18/372,924, filed Sep. 26, 2023, David J. Bohman.
(Continued)

*Primary Examiner* — Adam J Waggenspack

(57) ABSTRACT

A protective case system includes a protective case having a shell configured for receiving and removably retaining an electronic device. The protective case system also includes an accessory panel pivotably attached to the protective case, wherein the accessory panel is configured to pivot between a first position in which the accessory panel is positioned against a back surface of the protective case and a second position in which the accessory panel is configured to serve as a stand for the protective case. The protective case system also includes a device grip attached to the accessory panel.

17 Claims, 10 Drawing Sheets

(51) Int. Cl.

| | |
|---|---|
| ***A45C 13/00*** | (2006.01) |
| ***A45C 15/00*** | (2006.01) |
| ***A45F 5/00*** | (2006.01) |
| *A45C 11/00* | (2006.01) |

(52) U.S. Cl.

CPC ..... *A45F 5/1508* (2025.01); *A45F 5/1516* (2025.01); *A45F 5/1525* (2025.01)

(56) References Cited

U.S. PATENT DOCUMENTS 2,242,283 A 5/1941 Allen
2,374,629 A 4/1945 Thiele
3,023,885 A 3/1962 Kindseth
3,113,651 A 12/1963 Szabo et al.
3,168,173 A 2/1965 Koffler
3,275,336 A 9/1966 Warner, Jr.
3,289,798 A 12/1966 Gehrie
3,372,780 A 3/1968 Fujioka et al.
3,480,310 A 11/1969 Mcelwain
3,521,216 A 7/1970 Tolegian
3,786,391 A 1/1974 Mathauser
3,808,577 A 4/1974 Mathauser
3,810,258 A 5/1974 Mathauser
3,816,679 A 6/1974 Hotchkiss
4,029,999 A 6/1977 Neumann et al.
4,066,155 A 1/1978 Buchek
4,097,878 A 6/1978 Cramer
4,182,558 A 1/1980 Matsuo
4,431,333 A 2/1984 Chandler
4,584,718 A 4/1986 Fuller
4,856,658 A 8/1989 Novak
4,859,110 A 8/1989 Dommel
4,925,146 A 5/1990 Hegarty
4,933,988 A 6/1990 Thibault
4,940,414 A 7/1990 Lee
4,963,902 A 10/1990 Fukahori
4,981,243 A 1/1991 Rogowski
4,994,829 A 2/1991 Tsukamoto
5,025,921 A 6/1991 Gasparaitis et al.
5,054,733 A 10/1991 Shields
5,100,098 A * 3/1992 Hawkins ..... F16M 13/00 361/679.55
5,123,044 A 6/1992 Tate
5,138,523 A 8/1992 Benck et al.
5,235,495 A * 8/1993 Blair ..... G06F 1/166 361/740
5,359,756 A 11/1994 Miyauchi et al.
5,360,108 A 11/1994 Alagia
5,368,159 A 11/1994 Doria
5,380,968 A 1/1995 Morse
5,383,091 A 1/1995 Snell
5,386,084 A 1/1995 Risko
5,388,691 A 2/1995 White
5,388,692 A 2/1995 Withrow et al.
D365,927 S 1/1996 Cho
5,508,479 A 4/1996 Schooley
5,541,813 A 7/1996 Satoh et al.
5,604,050 A 2/1997 Brunette et al.
5,664,292 A 9/1997 Chen
5,671,120 A 9/1997 Kikinisi
5,992,807 A 11/1999 Tarulli
5,996,956 A 12/1999 Shawver
6,021,784 A * 2/2000 Yuhara ..... A45C 13/005 206/581
6,032,334 A 3/2000 Iima et al.
6,082,771 A 7/2000 Long et al.
6,097,593 A 8/2000 Faranda et al.
6,115,248 A 9/2000 Canova et al.
6,135,408 A 10/2000 Richter
6,149,116 A 11/2000 Won
6,151,206 A 11/2000 Kato et al.
6,302,617 B1 10/2001 Rumpp
6,305,588 B1 10/2001 Michel et al.
6,305,656 B1 10/2001 Wemyss
6,311,017 B1 10/2001 Mori
6,317,313 B1 11/2001 Mosgrove et al.
6,317,930 B1 * 11/2001 Hung ..... B25F 5/026 403/97
6,349,824 B1 2/2002 Yamada
6,375,009 B1 4/2002 Lee
6,409,531 B1 6/2002 Millard
6,445,577 B1 9/2002 Madsen et al.
6,456,487 B1 9/2002 Hetterick
6,464,524 B1 10/2002 Kerr et al.
6,490,155 B2 12/2002 Han et al.
6,514,624 B2 2/2003 Takemoto
6,545,862 B1 4/2003 Gettemy et al.
6,616,111 B1 9/2003 White
6,625,394 B2 9/2003 Smith et al.
6,626,362 B1 9/2003 Steiner et al.
6,646,864 B2 11/2003 Richardson
6,685,493 B2 2/2004 Birkenmaier et al.
6,701,159 B1 3/2004 Powell
6,705,580 B1 3/2004 Bain
6,762,935 B2 7/2004 Hidewasa
6,865,076 B2 3/2005 Lunsford
6,888,940 B1 5/2005 Deppen
6,966,519 B2 11/2005 Salentine et al.
7,050,841 B1 5/2006 Onda
7,072,699 B2 7/2006 Eiden
D526,780 S 8/2006 Richardson et al.
7,145,767 B2 12/2006 Mache et al.
7,158,376 B2 1/2007 Richardson et al.
7,180,735 B2 2/2007 Thomas et al.
7,194,291 B2 3/2007 Peng
D542,524 S 5/2007 Richardson et al.
7,230,823 B2 6/2007 Richardson et al.
7,236,588 B2 6/2007 Gartrell
7,287,738 B2 10/2007 Pitlor
7,311,526 B2 12/2007 Rohrbach et al.
7,343,184 B2 3/2008 Rostami
7,359,184 B2 4/2008 Lord
7,374,142 B2 5/2008 Carnevali
D574,819 S 8/2008 Andre et al.
7,431,251 B2 10/2008 Carnevali
D581,155 S 11/2008 Richardson et al.
D581,421 S 11/2008 Richardson et al.
D587,008 S 2/2009 Richardson et al.
D589,016 S 3/2009 Richardson et al.
7,555,325 B2 6/2009 Goros
7,558,594 B2 7/2009 Wilson
7,575,389 B2 8/2009 Nance
7,661,567 B2 2/2010 Myers
7,688,580 B2 3/2010 Richardson et al.
7,712,590 B1 5/2010 Lee
7,845,608 B1 12/2010 Chen et al.
7,871,218 B2 1/2011 Frey et al.
7,889,489 B2 2/2011 Richardson et al.
7,907,394 B2 3/2011 Richardson et al.
7,933,122 B2 4/2011 Richardson et al.
8,016,107 B2 9/2011 Emsky
8,049,727 B2 11/2011 Hanson et al.
8,204,561 B2 6/2012 Mongan et al.
8,303,336 B2 11/2012 Smith
8,442,604 B1 5/2013 Diebel
8,453,297 B2 6/2013 Wang
8,453,344 B2 6/2013 Nishiwaki et al.
8,453,835 B2 6/2013 So
8,457,701 B2 6/2013 Diebel
8,485,329 B1 7/2013 Roy et al.
8,490,783 B1 7/2013 Fan
8,509,865 B1 8/2013 LaColla et al.
8,514,568 B2 8/2013 Qiao et al.
8,550,317 B2 10/2013 Hyseni
8,560,031 B2 10/2013 Barnett et al.
8,567,599 B2 10/2013 Beatty et al.
8,599,547 B2 12/2013 Richardson et al.
8,608,502 B2 12/2013 Witter et al.
8,646,739 B2 2/2014 Moyer
8,676,281 B1 3/2014 Caulder et al.
8,706,175 B2 4/2014 Cho
8,737,066 B1 5/2014 Block
8,755,852 B2 6/2014 Hynecek et al.

(56) References Cited

U.S. PATENT DOCUMENTS 8,770,402 B2 7/2014 Bergreen et al.
8,777,002 B2 7/2014 Thomas et al.
8,794,686 B2 8/2014 Grieve
8,798,675 B2 8/2014 Salmon et al.
8,800,762 B2 8/2014 Fathollahi
8,830,663 B2 9/2014 Child et al.
8,844,098 B2 9/2014 Karmatz
8,875,879 B2 11/2014 Diebel et al.
D722,603 S 2/2015 Lay et al.
8,955,678 B2 2/2015 Murphy et al.
8,965,458 B2 2/2015 Richardson et al.
D725,119 S 3/2015 Gaylord
8,978,883 B2 3/2015 Gandhi et al.
D726,732 S 4/2015 Lay et al.
9,004,330 B2 * 4/2015 White ..... F16M 13/00 224/325
9,008,738 B1 4/2015 Dong
9,060,580 B2 6/2015 Tages
9,060,591 B1 6/2015 White
9,074,725 B2 * 7/2015 Trotsky ..... A45F 5/00
9,089,056 B2 7/2015 Rayner
9,098,238 B2 8/2015 Richardson et al.
D739,857 S 9/2015 Lay et al.
9,125,297 B2 9/2015 Magness
9,136,897 B2 9/2015 Hynecek et al.
9,153,112 B1 10/2015 Kiani et al.
9,226,057 B1 12/2015 Davis et al.
9,266,664 B2 2/2016 Bau
9,274,556 B2 3/2016 Gallouzi et al.
9,295,174 B2 3/2016 Witter et al.
9,301,584 B2 4/2016 Butts
9,316,026 B2 4/2016 Myers et al.
9,316,344 B2 4/2016 Gette et al.
9,367,090 B2 6/2016 Barnett et al.
9,377,154 B2 6/2016 Hung et al.
D762,258 S 7/2016 Jenkins
9,397,719 B1 7/2016 Schmidt
9,408,448 B2 8/2016 Kay et al.
D766,226 S 9/2016 Wu
D766,227 S 9/2016 Wu
D769,855 S 10/2016 Deng
9,462,099 B2 10/2016 Wilson et al.
9,470,358 B2 10/2016 Gette et al.
9,481,490 B2 11/2016 Venida et al.
9,487,376 B2 11/2016 Salentine et al.
9,503,147 B2 11/2016 Witter et al.
D775,115 S 12/2016 Ormsbee et al.
9,535,453 B2 1/2017 Dong
9,537,526 B2 1/2017 Wilson et al.
9,538,675 B2 1/2017 Gette et al.
9,545,140 B1 1/2017 Johnson et al.
9,615,476 B2 4/2017 Rayner et al.
9,622,556 B2 4/2017 Fathollahi et al.
9,654,605 B2 5/2017 Goldfain et al.
9,660,684 B2 5/2017 Rayner
9,706,830 B1 * 7/2017 Prince ..... F16G 13/00
9,743,540 B2 8/2017 Magness
9,765,921 B2 9/2017 Vogel et al.
9,774,713 B2 9/2017 Guerdrum et al.
D799,469 S 10/2017 Esses
9,787,348 B2 10/2017 Srour
9,788,620 B1 10/2017 Parkinson
9,800,283 B2 10/2017 Schmidt
9,806,549 B2 10/2017 Liberti et al.
9,807,211 B2 10/2017 Guerdrum et al.
9,851,758 B2 12/2017 Rowley
D808,376 S 1/2018 Kim
D808,377 S 1/2018 Witter et al.
9,871,550 B2 1/2018 Witter et al.
9,887,726 B1 2/2018 Mchatet
9,894,192 B2 2/2018 Cox, I
9,913,388 B1 3/2018 Mchatet
9,930,943 B2 4/2018 Lach et al.
9,980,548 B1 5/2018 Lai
D824,376 S 7/2018 Lee
10,019,034 B2 7/2018 Barnett et al.
10,027,783 B2 7/2018 Dukerschein et al.
10,030,807 B1 7/2018 Hobbs et al.
10,054,259 B2 8/2018 Hobbs et al.
10,058,155 B2 8/2018 Guerdrum et al.
10,060,573 B2 8/2018 Hobbs et al.
10,063,272 B1 8/2018 Yeo
D827,627 S 9/2018 Lee
D829,700 S 10/2018 Kim
10,103,769 B2 10/2018 Witter et al.
10,113,691 B2 10/2018 Grieve
10,136,716 B2 11/2018 Northrup et al.
D835,091 S 12/2018 Torrance
10,178,903 B2 1/2019 Guerdrum et al.
10,200,518 B2 2/2019 Richter
10,206,472 B1 2/2019 Northrup et al.
10,244,854 B1 4/2019 Haber et al.
10,278,299 B2 4/2019 Kim
D847,805 S 5/2019 Lederer
10,348,352 B2 * 7/2019 Barnett ..... F16M 13/04
10,349,728 B2 7/2019 Yoo
10,386,009 B2 8/2019 Hobbs et al.
10,389,860 B2 8/2019 Nahum et al.
10,413,027 B1 9/2019 Olson et al.
D864,581 S 10/2019 Bersh
10,463,116 B2 11/2019 Barnett et al.
10,484,522 B1 11/2019 Mchatet
D870,736 S 12/2019 Lederer
10,530,411 B2 1/2020 Gehlhausen et al.
10,610,004 B1 4/2020 Yeo
10,624,443 B2 4/2020 Haber et al.
10,655,775 B2 5/2020 Hobbs et al.
10,694,835 B2 * 6/2020 Peterson ..... A45C 11/00
10,728,754 B2 * 7/2020 Lee ..... H04M 1/026
10,742,251 B2 8/2020 Barnett et al.
D894,889 S 9/2020 Feller
10,953,535 B2 3/2021 Karmatz
11,161,649 B2 11/2021 Silsby
11,553,771 B2 1/2023 Yoon
11,564,480 B2 * 1/2023 Ruddy ..... A45F 5/00
11,572,977 B2 * 2/2023 Murphy ..... F16M 13/00
2001/0000617 A1 5/2001 Tracy
2001/0034923 A1 11/2001 Ho
2001/0054594 A1 12/2001 Maier-Hunke
2002/0065054 A1 5/2002 Humphreys et al.
2002/0079244 A1 6/2002 Kwong
2003/0141329 A1 7/2003 Huang
2004/0029405 A1 2/2004 Neidlein
2004/0150945 A1 8/2004 Mache et al.
2004/0182667 A1 9/2004 Lin
2005/0088811 A1 4/2005 Ulla et al.
2005/0213298 A1 9/2005 Doherty et al.
2005/0224508 A1 10/2005 Tajiri et al.
2005/0279661 A1 12/2005 Hodges
2005/0284904 A1 12/2005 Knapp et al.
2006/0027718 A1 2/2006 Quijano et al.
2006/0066438 A1 3/2006 Altounian et al.
2006/0086873 A1 4/2006 Chen
2006/0172765 A1 8/2006 Lev
2006/0237495 A1 10/2006 Chen et al.
2006/0243679 A1 11/2006 Dickerson
2006/0255493 A1 11/2006 Fouladpour
2007/0071423 A1 3/2007 Fantone et al.
2007/0115387 A1 5/2007 Ho
2007/0146985 A1 6/2007 Mick et al.
2007/0155448 A1 7/2007 Hong
2007/0158220 A1 7/2007 Cleereman et al.
2007/0181620 A1 8/2007 Carver
2007/0215659 A1 9/2007 Knapp et al.
2007/0215769 A1 9/2007 Nebeker et al.
2007/0297149 A1 12/2007 Richardson et al.
2008/0083797 A1 4/2008 Myers
2008/0117578 A1 5/2008 Moscovitch
2008/0163463 A1 7/2008 Hulden
2008/0199252 A1 8/2008 Frey et al.
2008/0304692 A1 12/2008 Zhang
2009/0001232 A1 1/2009 Seo et al.
2009/0034169 A1 2/2009 Richardson et al.
2009/0079665 A1 3/2009 Moscovitch

(56) References Cited

U.S. PATENT DOCUMENTS

| | | | |
|---|---|---|---|
| 2009/0084705 | A1 | 4/2009 | Justiss |
| 2009/0161903 | A1 | 6/2009 | White |
| 2009/0237377 | A1 | 9/2009 | Lai et al. |
| 2009/0283184 | A1 | 11/2009 | Han |
| 2010/0006468 | A1 | 1/2010 | Lin |
| 2010/0078343 | A1 | 4/2010 | Hoellwarth et al. |
| 2010/0090085 | A1 | 4/2010 | Corrion |
| 2010/0093412 | A1 | 4/2010 | Serra et al. |
| 2010/0122756 | A1 | 5/2010 | Longinotti-Buitoni |
| 2010/0141864 | A1 | 6/2010 | Lai |
| 2010/0147737 | A1 | 6/2010 | Richardson et al. |
| 2010/0181450 | A1 | 7/2010 | Hulick et al. |
| 2010/0195279 | A1 | 8/2010 | Michael |
| 2010/0203931 | A1 | 8/2010 | Hynecek et al. |
| 2010/0215188 | A1 | 8/2010 | Wilcox |
| 2010/0230301 | A1 | 9/2010 | Fellig |
| 2010/0301717 | A1 | 12/2010 | Wang |
| 2011/0031287 | A1 | 2/2011 | Gette et al. |
| 2011/0064401 | A1 | 3/2011 | DeSorbo |
| 2011/0073505 | A1 | 3/2011 | Stiehl |
| 2011/0073608 | A1 | 3/2011 | Richardson et al. |
| 2011/0075349 | A1 | 3/2011 | Ma et al. |
| 2011/0101058 | A1 | 5/2011 | Heckman |
| 2011/0170256 | A1 | 7/2011 | Lee |
| 2011/0192857 | A1 | 8/2011 | Rothbaum et al. |
| 2011/0216495 | A1 | 9/2011 | Marx |
| 2011/0228459 | A1 | 9/2011 | Richardson et al. |
| 2011/0235846 | A1 | 9/2011 | Jiang et al. |
| 2011/0294556 | A1 | 12/2011 | Carlberg et al. |
| 2011/0297566 | A1 | 12/2011 | Gallagher et al. |
| 2011/0309117 | A1 | 12/2011 | Roberts |
| 2011/0314651 | A1 | 12/2011 | Behar et al. |
| 2012/0018325 | A1 | 1/2012 | Kim |
| 2012/0031788 | A1 | 2/2012 | Mongan et al. |
| 2012/0037524 | A1 | 2/2012 | Thomas et al. |
| 2012/0037536 | A1 | 2/2012 | Thomas et al. |
| 2012/0043235 | A1 | 2/2012 | Klement |
| 2012/0074005 | A1 | 3/2012 | Johnson et al. |
| 2012/0092377 | A1 | 4/2012 | Stein |
| 2012/0104185 | A1 | 5/2012 | Carroll |
| 2012/0106069 | A1 | 5/2012 | Strauser |
| 2012/0111881 | A1 | 5/2012 | Gaddis et al. |
| 2012/0118770 | A1 | 5/2012 | Valls et al. |
| 2012/0170194 | A1 | 7/2012 | Lord et al. |
| 2012/0175474 | A1 | 7/2012 | Barnard et al. |
| 2012/0187260 | A1 | 7/2012 | Moyer |
| 2012/0228346 | A1 | 9/2012 | Huang |
| 2012/0252543 | A1 | 10/2012 | Cho |
| 2012/0267491 | A1 | 10/2012 | Chiu |
| 2012/0287565 | A1 | 11/2012 | Bennett |
| 2012/0325702 | A1 | 12/2012 | Gallagher et al. |
| 2012/0326003 | A1 | 12/2012 | Solow et al. |
| 2013/0027862 | A1 | 1/2013 | Rayner |
| 2013/0039521 | A1 | 2/2013 | Zhou et al. |
| 2013/0068915 | A1 | 3/2013 | Yang |
| 2013/0083953 | A1 | 4/2013 | Chang |
| 2013/0088813 | A1 | 4/2013 | Su et al. |
| 2013/0098788 | A1 | 4/2013 | McCarville et al. |
| 2013/0107449 | A1 | 5/2013 | Su et al. |
| 2013/0109253 | A1 | 5/2013 | Gammon et al. |
| 2013/0117487 | A1 | 5/2013 | Leung |
| 2013/0126533 | A1 | 5/2013 | Klosky |
| 2013/0175186 | A1 | 7/2013 | Simmer |
| 2013/0177181 | A1 | 7/2013 | Marcus |
| 2013/0181584 | A1 | 7/2013 | Whitten et al. |
| 2013/0220841 | A1 | 8/2013 | Yang |
| 2013/0220847 | A1 | 8/2013 | Fisher et al. |
| 2013/0222989 | A1 | 8/2013 | Chen |
| 2013/0230202 | A1 | 9/2013 | Widner et al. |
| 2013/0240578 | A1 | 9/2013 | Yu |
| 2013/0262248 | A1 | 10/2013 | Kim et al. |
| 2013/0292269 | A1 | 11/2013 | Tages |
| 2013/0292288 | A1 | 11/2013 | Willes |
| 2013/0303000 | A1 | 11/2013 | Witter et al. |
| 2013/0318775 | A1 | 12/2013 | Peters |
| 2014/0003647 | A1 | 1/2014 | Liu |
| 2014/0049142 | A1 | 2/2014 | Magness |
| 2014/0065847 | A1 | 3/2014 | Salmon et al. |
| 2014/0080553 | A1 | 3/2014 | Torset et al. |
| 2014/0097102 | A1 | 4/2014 | Piatt et al. |
| 2014/0099526 | A1 | 4/2014 | Powell et al. |
| 2014/0128132 | A1 | 5/2014 | Cox |
| 2014/0141838 | A1 | 5/2014 | Cai et al. |
| 2014/0152890 | A1 | 6/2014 | Rayner |
| 2014/0166707 | A1 | 6/2014 | Leisey-Bartsch |
| 2014/0168884 | A1 | 6/2014 | Wylie |
| 2014/0183064 | A1 | 7/2014 | Ge |
| 2014/0183065 | A1 | 7/2014 | Toulotte |
| 2014/0187289 | A1 | 7/2014 | Cataldo et al. |
| 2014/0200056 | A1 | 7/2014 | Liu |
| 2014/0227026 | A1 | 8/2014 | O'Neill et al. |
| 2014/0228074 | A1 | 8/2014 | Kulkarni et al. |
| 2014/0262848 | A1 | 9/2014 | Fathollahi et al. |
| 2014/0262934 | A1 | 9/2014 | Fathollahi et al. |
| 2014/0265765 | A1 | 9/2014 | Khodapanah et al. |
| 2014/0265767 | A1 | 9/2014 | Fathollahi |
| 2014/0299488 | A1 | 10/2014 | Andrew |
| 2014/0302896 | A1 | 10/2014 | Xu et al. |
| 2014/0325818 | A1 | 11/2014 | Mayfield |
| 2014/0355200 | A1 | 12/2014 | Thiers |
| 2014/0375877 | A1 | 12/2014 | Tages et al. |
| 2015/0061477 | A1 | 3/2015 | Wilson |
| 2015/0062787 | A1 | 3/2015 | Wilson et al. |
| 2015/0068935 | A1 | 3/2015 | Kay et al. |
| 2015/0083615 | A1 | 3/2015 | Lay et al. |
| 2015/0111623 | A1 | 4/2015 | Hegemier et al. |
| 2015/0133183 | A1 | 5/2015 | Alameh et al. |
| 2015/0141090 | A1 | 5/2015 | Hwan et al. |
| 2015/0141095 | A1 | 5/2015 | Kim |
| 2015/0153791 | A1 | 6/2015 | Wong |
| 2015/0172431 | A1 | 6/2015 | Huang |
| 2015/0189160 | A1 | 7/2015 | Auger et al. |
| 2015/0194997 | A1 | 7/2015 | Johnson et al. |
| 2015/0194998 | A1 | 7/2015 | Fathollahi |
| 2015/0195938 | A1 | 7/2015 | Witter et al. |
| 2015/0201723 | A1 | 7/2015 | Rayner et al. |
| 2015/0214989 | A1 | 7/2015 | Yeh et al. |
| 2015/0220766 | A1 | 8/2015 | Russell et al. |
| 2015/0257285 | A1 | 9/2015 | Wilson et al. |
| 2015/0257287 | A1 | 9/2015 | Tages |
| 2015/0304466 | A1 | 10/2015 | Tamatsu |
| 2015/0335138 | A1 | 11/2015 | Juarbe |
| 2016/0007705 | A1 | 1/2016 | Liebers et al. |
| 2016/0036478 | A1 | 2/2016 | Wong |
| 2016/0040825 | A1 | 2/2016 | Franklin |
| 2016/0045005 | A1 | 2/2016 | Richardson et al. |
| 2016/0072933 | A1 | 3/2016 | Cox |
| 2016/0080024 | A1 | 3/2016 | Wilson et al. |
| 2016/0122821 | A1 | 5/2016 | Liu et al. |
| 2016/0142093 | A1 | 5/2016 | Phang |
| 2016/0150861 | A1 | 6/2016 | Yao et al. |
| 2016/0157368 | A1 | 6/2016 | Dong |
| 2016/0164565 | A1 | 6/2016 | Witter et al. |
| 2016/0179143 | A1 | 6/2016 | Bidwell et al. |
| 2016/0183392 | A1 | 6/2016 | Kelley |
| 2016/0195898 | A1 | 7/2016 | Lau |
| 2016/0198822 | A1 | 7/2016 | Lee et al. |
| 2016/0254836 | A1 | 9/2016 | Alsberg et al. |
| 2016/0261133 | A1 | 9/2016 | Wang |
| 2016/0282905 | A1 | 9/2016 | Laine et al. |
| 2016/0286920 | A1 | 10/2016 | Lean et al. |
| 2016/0286921 | A1 | 10/2016 | Northrup et al. |
| 2016/0295981 | A1 | 10/2016 | Lay et al. |
| 2016/0345715 | A1 | 12/2016 | Lin et al. |
| 2016/0347257 | A1 | 12/2016 | Buchanan |
| 2017/0026498 | A1 | 1/2017 | Goldfain et al. |
| 2017/0041037 | A1 | 2/2017 | Witter et al. |
| 2017/0099922 | A1 | 4/2017 | Guerdrum et al. |
| 2017/0099924 | A1 | 4/2017 | Fathollahi et al. |
| 2017/0119120 | A1 | 5/2017 | Richardson et al. |
| 2017/0195000 | A1 | 7/2017 | Srour |
| 2017/0237460 | A1 | 8/2017 | Rayner |
| 2017/0253380 | A1 | 9/2017 | Boyer et al. |
| 2017/0279478 | A1 | 9/2017 | Fathollahi |

(56) References Cited

U.S. PATENT DOCUMENTS

| | | | |
|---|---|---|---|
| 2017/0327054 | A1 | 11/2017 | Yu et al. |
| 2017/0328514 | A1 | 11/2017 | Cavalcante et al. |
| 2017/0328517 | A1 | 11/2017 | Wessels |
| 2017/0353208 | A1 | 12/2017 | Wilson et al. |
| 2017/0359096 | A1 | 12/2017 | Witter et al. |
| 2017/0360200 | A1 | 12/2017 | Cohen |
| 2018/0013463 | A1 | 1/2018 | Jeon |
| 2018/0101197 | A1 | 4/2018 | Barnett et al. |
| 2018/0136695 | A1 | 5/2018 | Lo et al. |
| 2018/0167498 | A1 | 6/2018 | Drakos |
| 2018/0369599 | A1 | 12/2018 | Smith |
| 2019/0055062 | A1 | 2/2019 | Winn |
| 2019/0094853 | A1 | 3/2019 | Overall |
| 2019/0104623 | A1 | 4/2019 | Backus |
| 2019/0141848 | A1 | 5/2019 | Sung |
| 2019/0208046 | A1 | 7/2019 | Gluck |
| 2019/0211966 | A1 | 7/2019 | Nahum et al. |
| 2019/0212774 | A1 | 7/2019 | Patterson et al. |
| 2019/0215387 | A1 | 7/2019 | Chiang |
| 2019/0222682 | A1 | 7/2019 | Ren et al. |
| 2019/0225378 | A1 | 7/2019 | Barnett |
| 2019/0229763 | A1 | 7/2019 | Nebel et al. |
| 2019/0243421 | A1 | 8/2019 | Barnett et al. |
| 2019/0245960 | A1 | 8/2019 | Nahum et al. |
| 2019/0250664 | A1 | 8/2019 | Eslava et al. |
| 2019/0278327 | A1 | 9/2019 | Barnett et al. |
| 2019/0278328 | A1 | 9/2019 | Barnett et al. |
| 2019/0281147 | A1 | 9/2019 | Sherburne et al. |
| 2019/0281960 | A1 | 9/2019 | Peterson et al. |
| 2019/0281961 | A1 | 9/2019 | Peterson et al. |
| 2019/0286191 | A1 | 9/2019 | Correll, Jr. |
| 2019/0335030 | A1 | 10/2019 | Nahum et al. |
| 2019/0335031 | A1 | 10/2019 | Nahum et al. |
| 2019/0350352 | A1 | 11/2019 | Chou et al. |
| 2021/0153635 | A1 | 5/2021 | Vasquez et al. |
| 2021/0250056 | A1 | 8/2021 | Sung |
| 2021/0314430 | A1 | 10/2021 | Backus |
| 2022/0087386 | A1* | 3/2022 | Wright ..... A45C 1/06 |
| 2022/0304457 | A1 | 9/2022 | Cornish et al. |
| 2023/0044185 | A1 | 2/2023 | Troy et al. |
| 2023/0189970 | A1 | 6/2023 | Cornish et al. |

FOREIGN PATENT DOCUMENTS

| | | | |
|---|---|---|---|
| KR | 200446444 | | 10/2009 |
| KR | 101394285 | | 5/2014 |
| KR | 102025187 | B1 | 9/2019 |
| WO | 1994000037 | A1 | 1/1994 |
| WO | 1999041958 | A1 | 8/1999 |
| WO | 2015103599 | A1 | 7/2015 |

OTHER PUBLICATIONS

Otterbox, "OtterBox and PopSockets Announce Swappable, Unstoppable Otter+Pop," dated Jan. 7, 2019, downloaded from http://media.otterbox.com/2019-01-07-OtterBox-and-PopSockets-Announce-Swappable-Unstoppable-Otter-Pop Jul. 3, 2019.

Otterbox, "Swappable, Unstoppable: OtterBox and PopSockets Cases Available Now," dated Mar. 26, 2019, downloaded from http://media.otterbox.com/2019-03-26-Swappable-Unstoppable-OtterBox-and-PopSockets-Cases-Available-Now Jul. 3, 2019.

Outfityours.com (Top 5 Best Clear iPhone 5S and iPhone 5 Cases—Incase, Otterbox, Griffin, Moshi [retrieved from https://www.youtube.com/watch?v=rWYKJvsDHPw], YouTube.com [online], May 17, 2013 [retrieved Oct. 11, 2017}, 3 pages.

Randomrazr (NEW Otterbox Symmetry Case—The Slim Protective Case for the iphone 5S/5C [retrieved from https://wwwyoutube.com/watch?v=zGWZTGamuT0], YouTube.com [online], Mar. 30, 2014 [retrieved Oct. 11, 2017]), 5 pages.

* cited by examiner

PROTECTIVE CASE WITH GRIP AND STAND

CROSS REFERENCE TO RELATED APPLICATIONS

This application claims priority to U.S. Provisional Patent Application No. 63/423,893, filed Nov. 9, 2022, which is hereby incorporated by reference in its entirety.

BACKGROUND

Electronic devices, particularly portable electronic devices, are used for a growing variety of purposes, as well as in a growing variety of situations. Examples of portable electronic devices include smartphones, tablet computers, gaming devices, audio players, video players, cameras, portable computers, two-way radios, GPS receivers, and/or other portable electrical or electronic devices. These types of devices are susceptible to damage from a variety or forces or elements such as dropping, impact, and scratching. Improved gripping and stand apparatuses are needed to satisfy changing use models, while also protecting the devices. At the same time, grips and device stands may interfere with use of other accessories with the devices, such as wireless charging devices.

SUMMARY

In one exemplary embodiment, a protective case system for use with an electronic device is provided. The protective case system includes a protective case comprising a shell configured for receiving and removably retaining the electronic device, a device grip, and a pivoting accessory panel attached to the protective case, wherein the device grip is attached to the pivoting accessory panel.

Other embodiments, including various combinations of the features disclosed herein, are also envisioned. Many combinations of the features are possible, including combinations that do not include all of the described features and/or include other features.

DETAILED DESCRIPTION

Electronic devices are increasingly used with protective cases and/or with covers that protect the electronic devices from a variety or forces or elements such as dropping, impact, and scratching. As people carry electronic devices with them more frequently, they have become more interested in using them for a wider variety of tasks and in a wider variety of situations. Electronic devices, particularly portable electronic devices, are now being used more than ever and the longer devices are held by the user the greater the chance they may be dropped or otherwise damaged. In addition, people are using their electronic devices in a greater variety of situations. In some cases, these challenges are coupled with an increasing need for holders, grips, or stands to make it easier to use these devices in a variety of situations. There may also be a desire to hold the device in a particular preferred configuration or location when the user wants the device to be visible and/or in a particular orientation but may not necessarily be holding it.

At the same time, electronic devices are also being used with an increasing number of accessories. In some examples, the accessories may be temporarily attached to the electronic device or placed near the back of electronic device. Specifically, wireless chargers or wireless charging devices are sometimes used to recharge portable electronic devices. The nature of inductive wireless charging is such that the charger must be within a specified distance of the electronic device for charging to occur. Other types of accessories may also be used with portable electronic devices or temporarily attached to the back of the portable electronic devices. One set of examples are MAGSAFE ACCESSORIES and MAGSAFE wireless chargers provided by APPLE and/or compatible with APPLE devices. Sometimes these devices must be placed within a specified distance of the primary housing of the electronic device in order to operate properly. Protective cases must be relatively thin in order for the accessory to still work when the electronic device is in the protective case. Grip devices provide an additional challenge in that they often result in incremental thickness in addition to the protective case. Convenient solutions are needed for temporarily storing a grip device and/or temporarily moving it out of the way when these types of accessories will be used.

While most of the electronic device cases and/or covers discussed herein are described as "protective" cases, the apparatuses and techniques disclosed herein do not necessarily require that the case is protective and could apply to any type of electronic device case, cover, sleeve, and/or shell. In other examples, the case may be water-resistant or water proof for protecting the electronic device from water or other liquids. In yet other examples, the case may have other characteristics, such as, but not limited to, chemical resistance and/or antimicrobial characteristics.

Figure 1:
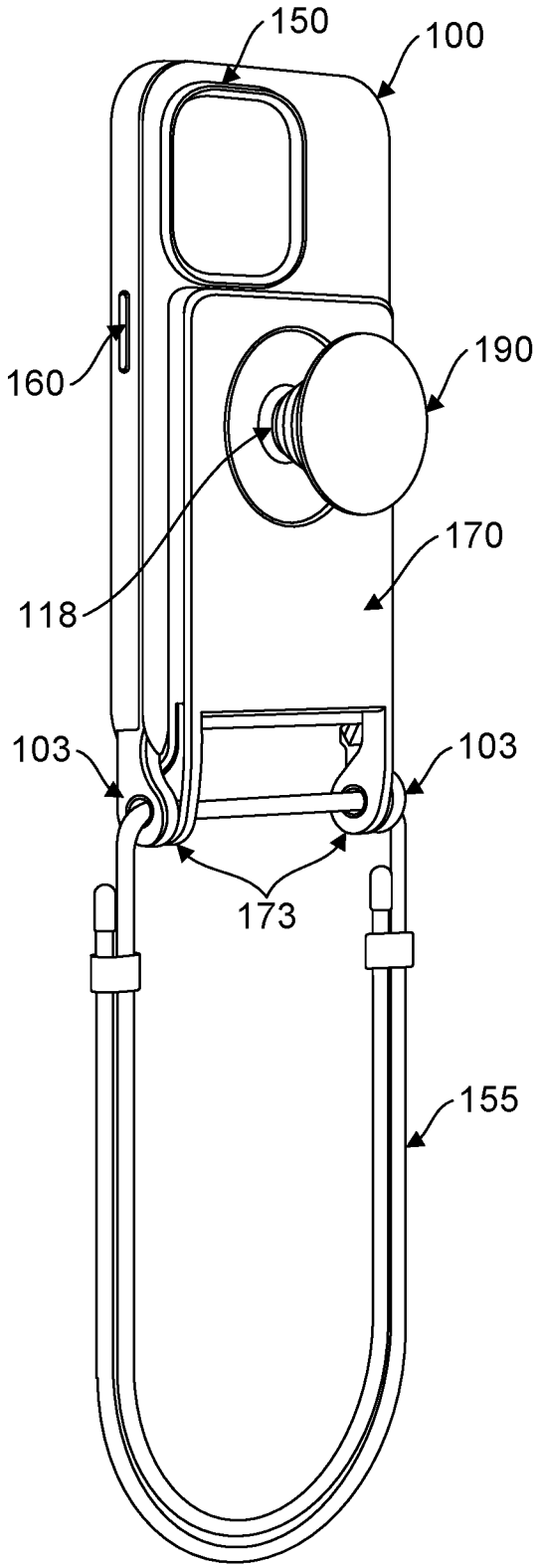
FIG. 1 illustrates a back perspective view of a protective case with an accessory panel that includes a configurable device grip and also functions as a stand.

FIG. 1 illustrates a back perspective view of a protective case 100 with a device grip 190 and an accessory panel 170 that may be used as a stand. Protective case 100 is configured for receiving and holding an electronic device. Protective case 100 includes a front opening which permits or allows insertion of the electronic device and access to at least some portion of the installed electronic device (see FIG. 2). In one example, the front opening permits access to an interactive interface of the electronic device such as a touchscreen, a touch screen interface, a resistive touchscreen, a display, and/or a capacitive touchscreen. The front opening may contain a lip or edge that removably retains the electronic device in the protective case such that it does not easily or readily come out of the protective case but can still be intentionally removed by a user when desired. The front opening may also include a lip, ledge, protrusion, raised edge, rim, elevated rim, elevated protective rim, or other raised feature around at least a portion of the front opening to reduce chances that the interactive interface of the installed electronic device comes into contact with another object or surface, particularly when protective case 100 is laid face down on a flat surface, such as a table. Protective case 100 may include multiple layers and/or materials, including an internal cushion layer or liner.

Protective case 100 also includes camera aperture 150 in a back surface of protective case 100. Camera aperture 150 provides optical access and/or an optical path to/from a camera and/or a flash of the installed electronic device. In other words, camera aperture 150 permits use of the camera and/or flash even though the electronic device is installed in protective case 100 and much of the back of the electronic device is covered by protective case 100. Camera aperture 150 may be covered with a clear, mostly clear, transparent, or mostly transparent membrane, lens, or film that protects the camera and/or the flash but also still permits optical access and/or an optical path to/from the camera and/or flash. In some examples, the membrane or film may serve a lensing function and/or provide an optical effect, such as magnification.

Protective case 100 provides protection for an installed electronic device against external forces by reducing or eliminating transfer of those forces to the installed electronic device, as well as providing a relatively soft contact surface for the installed electronic device. The relatively soft contact surface can resist scratching, scraping, marring, and/or rub marks. While providing protection, protective case 100 enables a user to still have the ability to use the electronic device while it is installed in protective case 100.

Protective case 100 also includes one or more button pads 160 on one or more sides of protective case 100. In some cases, button pads 160 may be formed in or from the material that makes up an inner surface of protective case 100. Button pads 160 correspond to respective buttons or control features of an installed electronic device. Button pads 160 enable actuation or operation of the respective buttons or control features of the installed electronic device from outside of protective case 100 without necessarily having direct access to the buttons or control features. Protective case 100 may also include another aperture, hole, or opening for directly accessing a button, switch, port, or control feature of the installed electronic device. Button pads and apertures may have many other shapes or configurations. Protective case 100 may have more or fewer button pads or apertures than illustrated, or no button pads or apertures at all.

Protective case 100 may also permit access to other features of an installed electronic device. For example, protective case 100 may permit access to an audio feature of the electronic device, such as a speaker, microphone, and/or headphone jack of the electronic device. In some configurations, protective case 100 may include an aperture with a water impermeable membrane that allows sound to pass through the membrane while keeping water from passing through the associated aperture.

As illustrated In FIG. 1, protective case 100 also includes accessory panel 170 which is pivotably attached to the main body of protective case 100. A device grip 190 is attached to accessory panel 170. Device grip 190 may be used with electronic devices and protective cases or covers as described herein. Device grip 190 is one example of a device grip, or holder. The particular device grip illustrated in FIG. 1 is a POPSOCKET sold by POPSOCKETS of Boulder, Colorado. Device grip 190 is used in the examples herein only for explanation purposes. The improvements discussed herein are not limited to the particular device grip 190 illustrated in FIG. 1 and may be applicable to many different types of device grips, holders, and/or stands.

Accommodating different grips, holders, and/or stands may include changing shapes, sizes, dimensions, geometries, quantities, and/or positions of case features described herein to accommodate other grips, holders, or stands. In some examples, device grip 190 may also be called a grip device, a ring holder, a finger loop, a strap, or a holder.

Device grip 190 may include a grip end, an expanding portion, and a foot. The foot may be attached to an object, permanently or removably, to allow device grip 190 to assist in the holding the object and/or make it less likely the object is dropped. The expanding portion may have an accordion or tapered accordion structure to allow it to be expanded or adjusted into various positions. For example, device grip 190 may have an extended or use position in which the expanding portion is partially or fully extended. Device grip 190 may also have a non-extended, stowed, or compressed position in which a height of device grip 190 is reduced or minimized in order to reduce its interference with other objects or activities when it is not in use. The techniques and improvements herein may be practiced with a wide variety of other device grips and/or other device grip designs. Device grip 190 of FIG. 1 is used herein only for purposes of explanation and the improvements disclosed herein are not to be limited to any specific design or type of grip or holder.

It may be desirable to place a wireless charging device adjacent to a back surface of protective case 100 to recharge a battery of the installed electronic device. Wireless chargers typically must be within a specified distance of the surface of the primary housing of the electronic device to work properly or efficiently. In some examples, device grip 190, even in the stowed position, may be too thick in conjunction with protective case 100 such that it keeps a charger or other accessory from working or from working well. In these situations, it may be desirable to temporarily remove or move device grip 190 out of the way. As discussed in more detail with respect to subsequent figures, pivoting accessory panel 170 allows device grip 190 to conveniently be moved out of the way without disconnecting or detaching it from the assembly. Accessory panel 170 may be temporarily held in the position illustrated in FIG. 1 by one or more magnetic and/or metallic elements. The magnetic and/or metallic elements may be in any combination of the electronic device, protective case 100, and/or accessory panel 170. In this way, accessory panel 170 and device grip 190 can be pivoted when a sufficient force is applied.

While many of the examples herein discuss repositioning of device grip 190 for purposes of wireless charging, the improvements herein are also equally applicable to temporary movement and/or removal of device grip 190 for other reasons. FIG. 1 illustrates a use position in which grip 190 is directly behind protective case 190 and is in an extended position to assist a user in holding protective case 100 and an installed electronic device.

FIG. 1 also illustrates a lanyard 155 which may be used to carry, hang, or secure protective case 100 and the installed electronic device. Lanyard 155 may be constructed from one or more flexible cords or cables. Lanyard 155 may be adjustable in length and may be removable and/or replaceable. Lanyard 155 is illustrated as being threaded through openings in the hinge portions of the assembly, however lanyard 155 may be attached to protective case 100 or to the assembly in other manners, and may also be removable.

Figure 2:
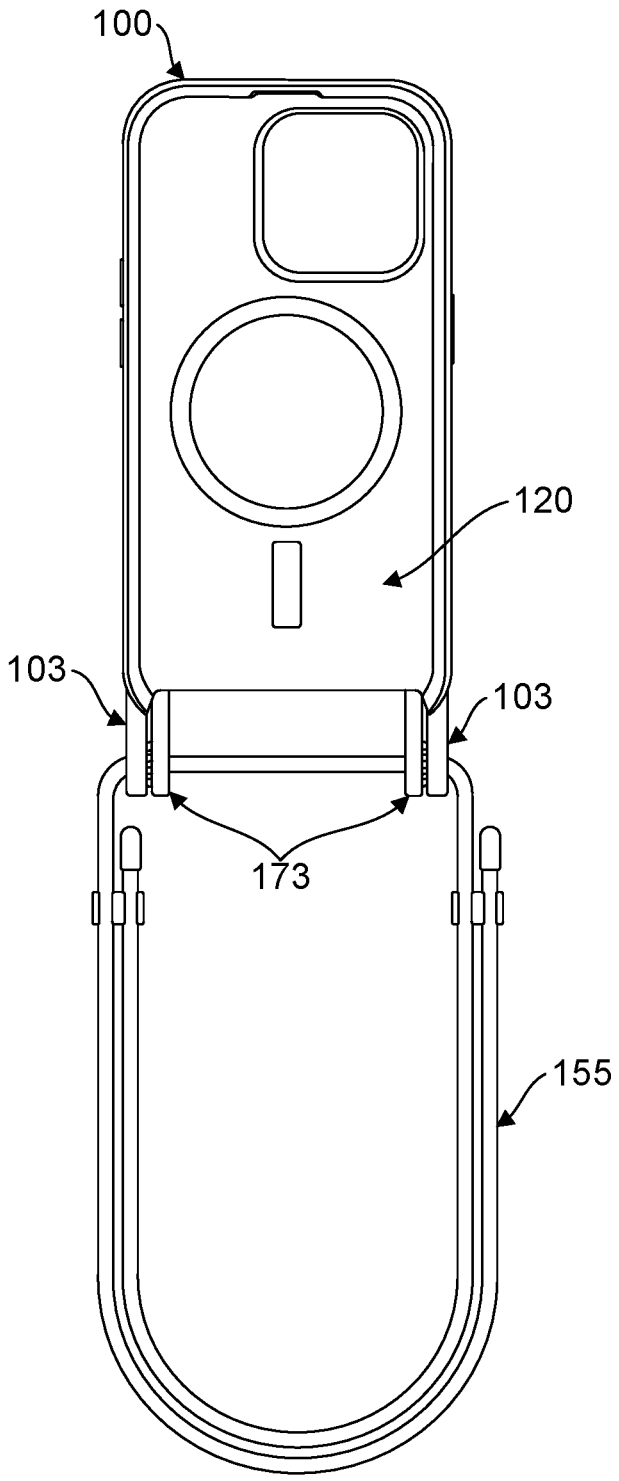
FIG. 2 illustrates a front view of the protective case.
Figure 3:
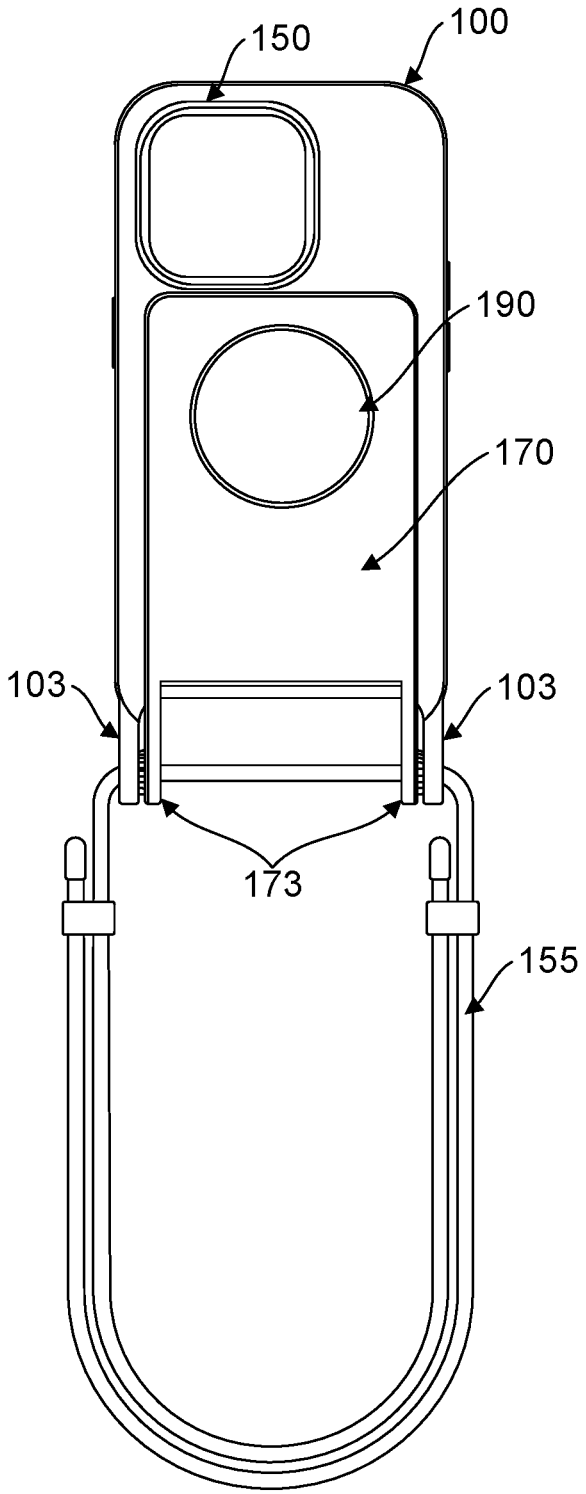
FIG. 3 illustrates an alternative view of the protective case.

FIG. 2 illustrates a front view of protective case 100 without an electronic device installed. FIG. 2 illustrates an inside surface 120 of protective case 100 which is configured to receive the electronic device when the electronic device is installed in protective case 100. Inside surface 120 may be or may include one or more cushioning members. In FIG. 2, accessory panel 170 and device grip 190 are not visible because they are on the opposite side of protective case 100 in FIG. 2. FIG. 3 illustrates an alternative back view of protective case 100.

Figure 4:
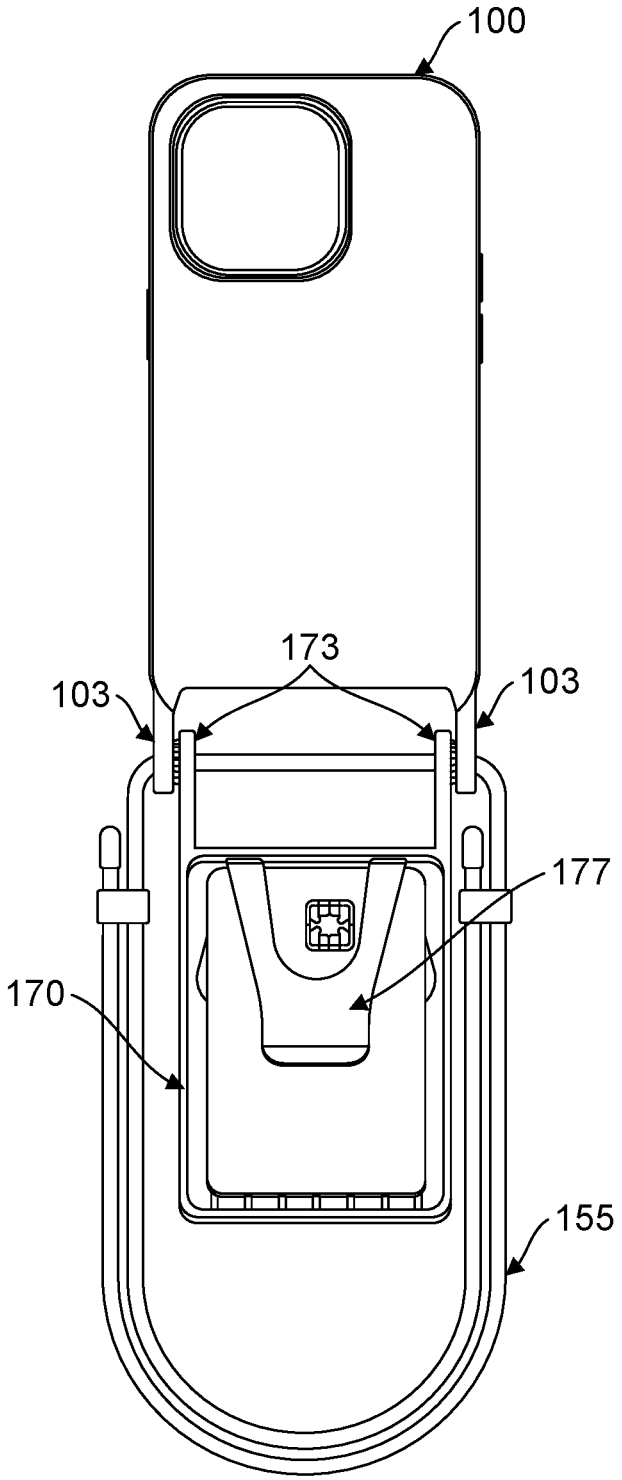
FIG. 4 illustrates an alternative configuration of the protective case.

FIG. 4 illustrates the view of FIG. 3 but with accessory panel 170 in a rotated, pivoted, or deployed position. FIG. 4 also illustrates that accessory panel 170 optionally includes a card storage location on a bottom side of accessory panel 170 and optionally includes a card retention device 177. Card retention device 177 may be a spring loaded clip to hold one or more of a credit card, a driver's license, a business card, or cash. Protective case 100 includes hinge arms 103 which engage hinge arms 173 of accessory panel 170. Accessory panel 170 is pivotally attached to protective case 100 through hinge arms 173 and hinge arms 103 the operation of which are discussed in further detail with respect to subsequent figures. More or fewer hinge arms are possible. Other hinging, pivoting, or attachment mechanisms are possible, including a friction hinge or a living hinge.

The configuration of FIG. 4 may be convenient or necessary when an accessory, such as a wireless charging device, is used with an electronic device that is installed in protective case 100. This configuration is beneficial as compared to completely removing or disconnecting device grip 190 and/or accessory panel 170 from protective case 100 because it reduces the chances that a user will lose, misplace, and/or forget device grip 190 if it were disconnected from the assembly. This configuration may also be beneficial for use with stands, desks stands, magnetic stands, mounts, magnetic mounts, wireless charging mounts, and/or wireless charging stands.

Figure 5:
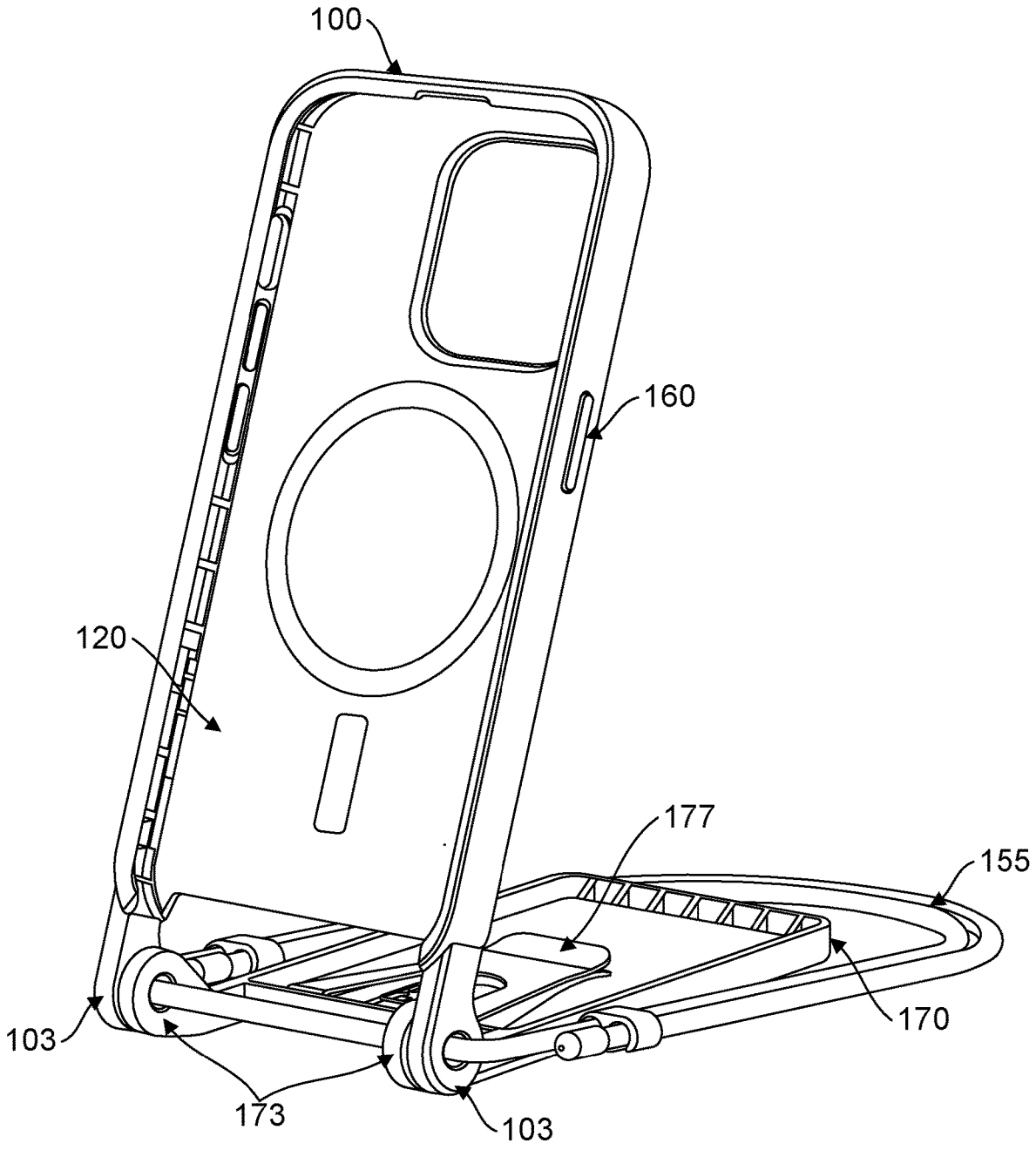
FIG. 5 illustrates the protective case in a first stand configuration.

FIG. 5 illustrates protective case 100 in a first stand configuration. Accessory panel 170 has been rotated slightly less than 90 degrees from the position of FIG. 1 to the illustrated position in which protective case 100 and an installed electronic device will sit on a substantially horizontal surface in a portrait viewing position. The assembly will maintain this position on the substantially horizontal surface without having to be held by a user. Accessory panel 170 may tend to stay in this position through friction or stiction at hinge arms 103 and 173 or through other methods discussed in more detail with respect to subsequent figures.

Figure 6:
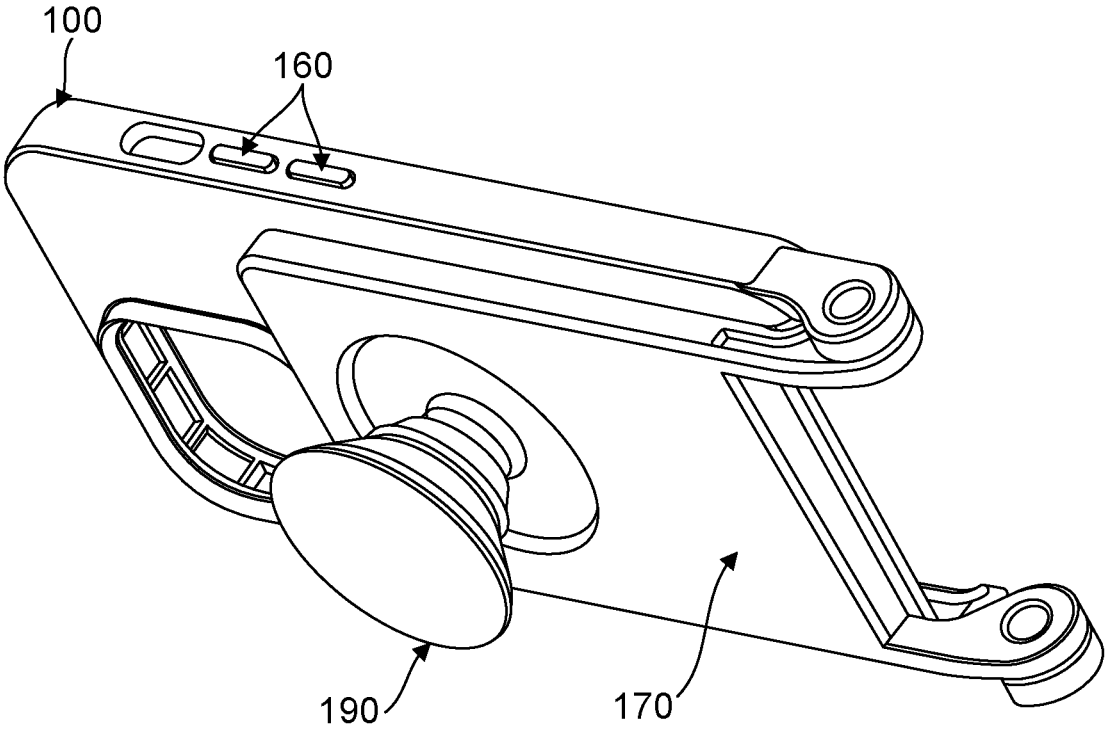
FIG. 6 illustrates the protective case in a second stand configuration.

FIG. 6 illustrates protective case 100 in a second stand configuration. In FIG. 6, accessory panel 170 is in a stowed position and device grip 190 is in an extended or use position. This configuration allows protective case 100 and an installed electronic device to sit on a substantially horizontal surface in a landscape viewing position. The assembly will maintain this position on the substantially horizontal surface without having to be held by a user.

Figure 7:
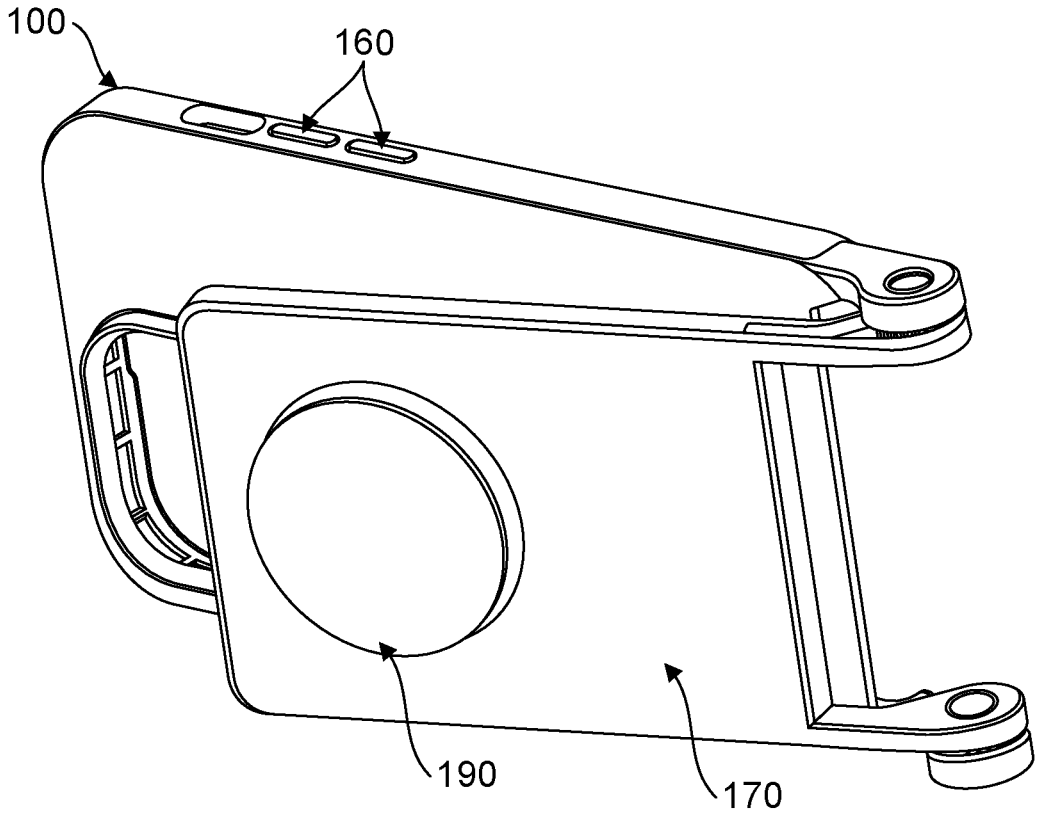
FIG. 7 illustrates the protective case in a third stand configuration.

FIG. 7 illustrates protective case 100 in a third stand configuration. In FIG. 7, accessory panel 170 is in a partially extended or pivoted position and device grip 190 is in a stowed position. Somewhat similar to FIG. 6, this configuration enables protective case 100 and an installed electronic device to sit on a substantially horizontal surface in a landscape viewing position. The assembly will maintain this position on the substantially horizontal surface without having to be held by a user. In this example, accessory panel 170 can be pivoted further one direction or another to change the viewing angle.

Figure 8:
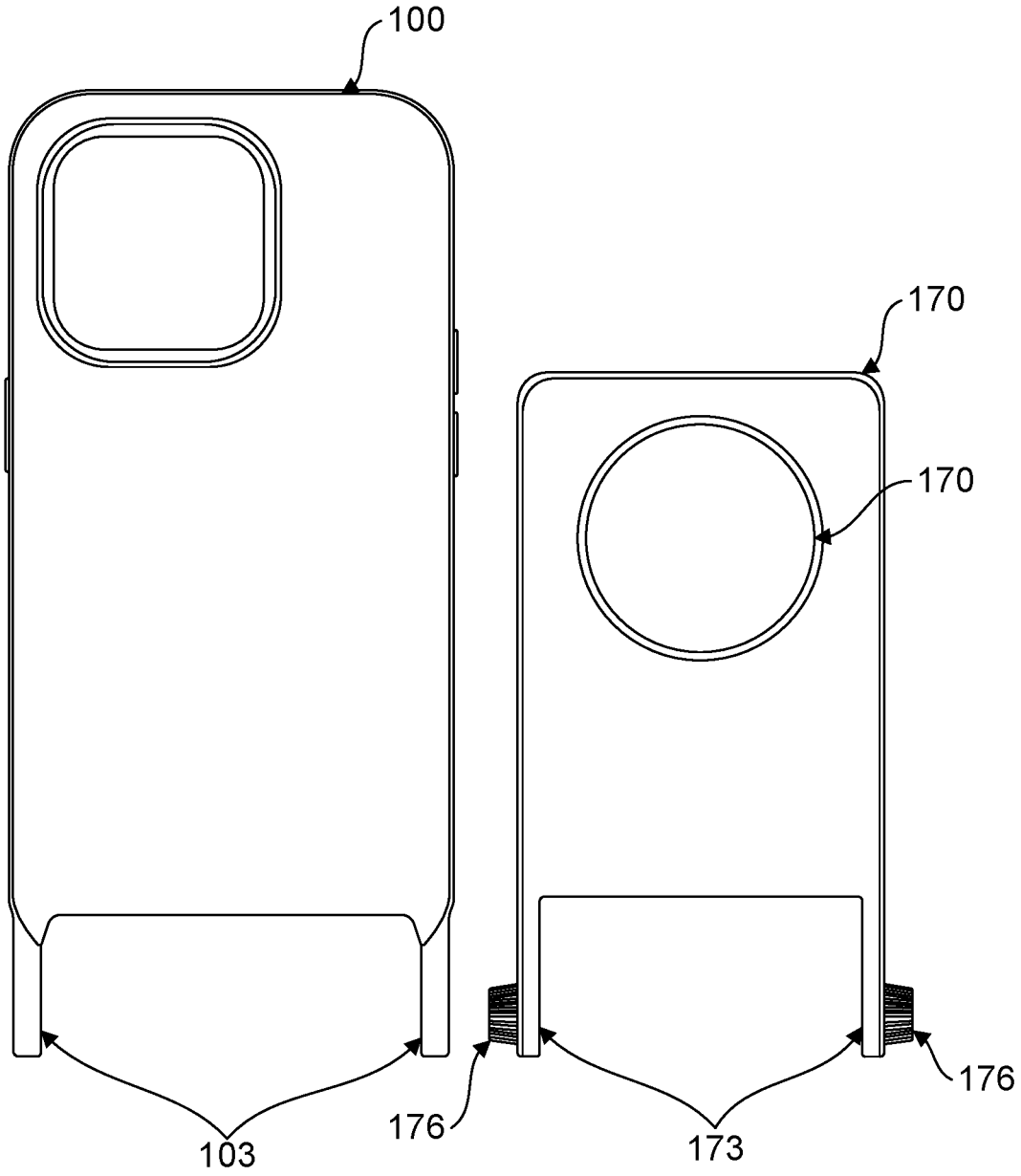
FIG. 8 illustrates the protective case with the accessory panel detached.
Figure 9:
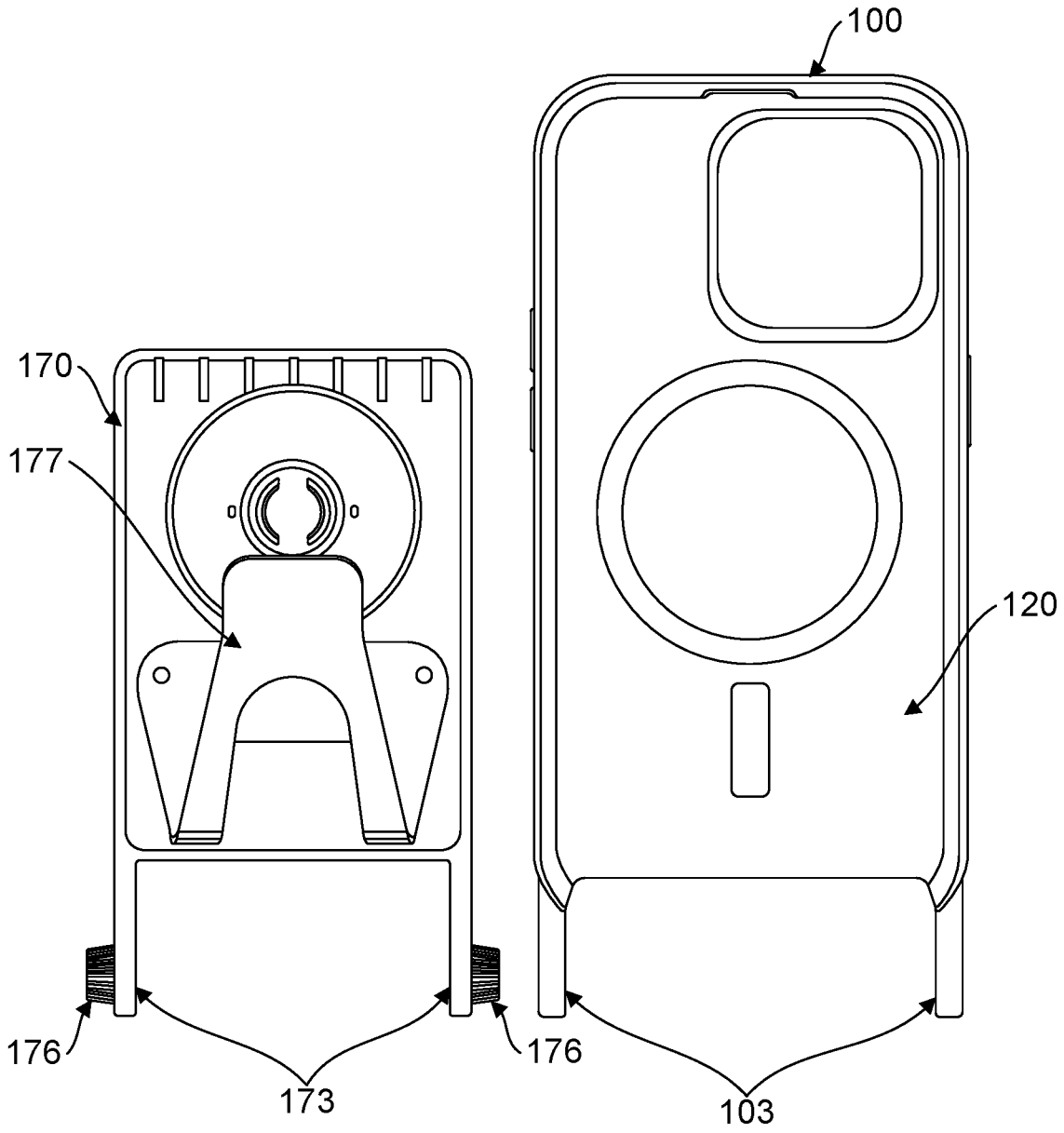
FIG. 9 illustrates an alternate view of the configuration of FIG. 8.

FIG. 8 illustrates protective case 100 with accessory panel 170 detached. This configuration may be used for temporarily moving accessory panel 170 and device grip 190 out of the way for charging or other purposes. This configuration may be used as an alternate approach to that of FIG. 4, or may simply be used if replacement of accessory panel 170 is necessary. FIG. 9 illustrates an alternate view of the configuration of FIG. 8 from an opposite side with no electronic device installed.

Figure 10:
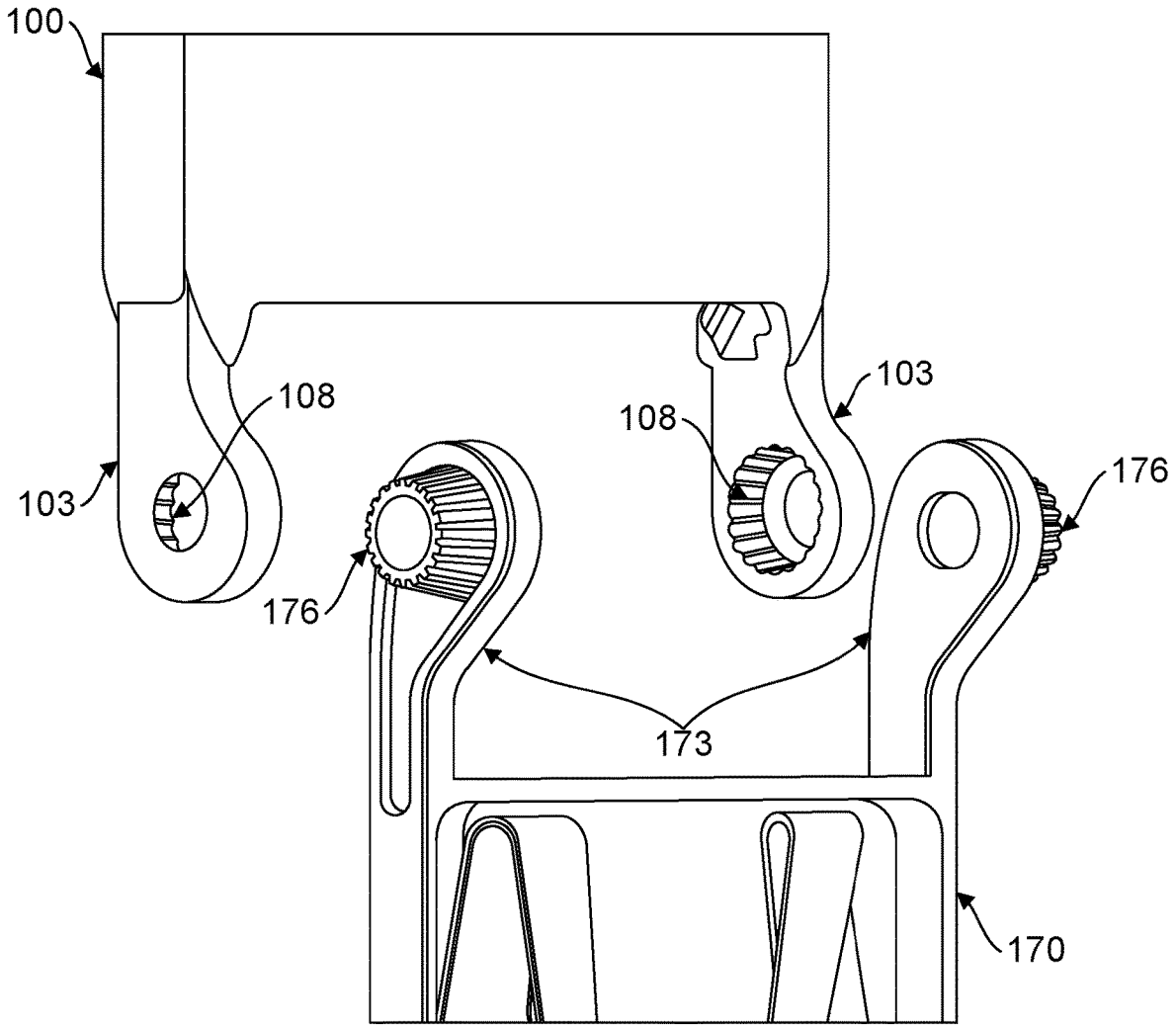
FIG. 10 illustrates a close up view of the attachment interface of the protective case and the accessory panel.

FIG. 10 illustrates a close up view of the hinge elements of a configuration similar to FIGS. 8 and 9 in which accessory panel 170 is detached from protective case 100. FIG. 10 illustrates that each of hinge arms 173 of accessory panel 170 includes a conical hub 176. FIG. 10 also illustrates that each of hinge arms 103 of protective case 100 includes a conical receiver 108.

Each of conical hubs 176 includes a plurality of splines or protrusions. Each of conical receivers 108 include a plurality of splines or recesses that correspond, mate, and/or engage with the splines of conical hubs 176, respectively. When the splines are engaged, accessory panel 170 cannot be rotated with respect to protective case 100 unless a large enough force is applied to bend hinge arms 173 inward to disengage the splines. Since conical hubs 176 and conical receivers 108 are conically shaped, hinge arms 173 must be flexed, squeezed, or forced together a specified distance before the splines are sufficiently disengaged for pivoting or rotation to occur. The hubs and receivers illustrated in FIG. 10 could also be reversed and, in an alternate implementation, be included on the opposite of protective case 100 and accessory panel 170.

The configuration illustrated in FIG. 10 creates discrete detents or steps to which arm 130 can be moved or rotated. The assembly may also be described as having a ratcheting behavior. Other spline layouts and hinge configurations are possible. The other improvements disclosed herein may be practiced and implemented with another type of hinge, a friction hinge, a living hinge, and/or another mechanical interface which permits pivoting or rotation.

Various components described herein may be manufactured, provided, or sold in the form of a system or a kit. The system or kit may include any combination of: a protective case or cover having any combination of the features described, a compatible device grip, and/or any of the other components disclosed herein. The system or kit need not include every component or feature described herein.

The elements, components, and steps described herein are meant to exemplify some types of possibilities. In no way should the aforementioned examples limit the scope of the invention, as they are only exemplary embodiments.

The phrases "in some embodiments," "according to some embodiments," "in the embodiments shown," "in other embodiments," "in some examples," "in other examples," "in some cases," "in some situations," "in one configuration, " "in another configuration," and the like generally mean that the particular technique, feature, structure, or characteristic following the phrase is included in at least one embodiment of the present invention and/or may be included in more than one embodiment of the present invention. In addition, such phrases do not necessarily refer to the same embodiments or to different embodiments.

The foregoing disclosure has been presented for purposes of illustration and description. Other modifications and variations may be possible in view of the above teachings.

The embodiments described in the foregoing disclosure were chosen to explain the principles of the concept and its practical application to enable others skilled in the art to best utilize the invention. It is intended that the claims be construed to include other alternative embodiments of the invention except as limited by the prior art.

What is claimed is:

1. A protective case system for use with an electronic device, the protective case system comprising:

a protective case comprising a shell configured for receiving and removably retaining the electronic device, the shell comprising two receivers each having a plurality of splines;

an accessory panel pivotably attached to the protective case with two flexible hinge arms, wherein each flexible hinge arm includes a hub having a plurality of splines configured to engage the splines of a respective one of the two receivers of the shell, wherein the accessory panel is configured to pivot between a first position in which the accessory panel is positioned against a back surface of the protective case and a second position in which the accessory panel is configured to serve as a stand for the protective case and the installed electronic device for supporting the protective case and the installed electronic device in a viewing orientation on a substantially horizontal surface, and wherein both sets of hubs and receivers are engaged in both the first position and the second position; and a device grip attached to the accessory panel.

2. The protective case system of claim 1 wherein the device grip is removably attached to the accessory panel.

3. The protective case system of claim 1 wherein the device grip is extendable between a stowed position and an extended position.

4. The protective case system of claim 1 further comprising a lanyard attached to the protective case.

5. The protective case system of claim 4 wherein a length of the lanyard is adjustable.

6. The protective case system of claim 4 wherein the lanyard is removably attached to the protective case.

7. The protective case system of claim 1 wherein the accessory panel includes a recessed storage location configured for storing one or more of a credit card, a driver's license, and cash.

8. The protective case system of claim 1 wherein the two flexible hinge arms are configured to flex towards each other to disengage the splines of the hubs and the receivers to enable the accessory panel to pivot between the first position and the second position.

9. The protective case system of claim 4 wherein the lanyard is threaded through openings in the hubs and the receivers.

10. The protective case system of claim 1 wherein the second position is a portrait viewing orientation, wherein the accessory panel is further configured to also pivot to a third position, and wherein the third position is a landscape viewing orientation.

11. The protective case system of claim 1 wherein the accessory panel is temporarily held in the first position magnetically.

12. A protective case for use with a portable electronic device, the protective case comprising:

a shell adapted for receiving and removably retaining the portable electronic device, wherein the shell covers a back and at least a portion of sides of the portable electronic device when the portable electronic device is removably installed in the shell, and wherein the shell includes two receivers attached to the shell, each receiver having a plurality of splines;

an accessory panel pivotably attached to the shell with two flexible hinge arms, wherein each flexible hinge arm includes a hub having a plurality of splines configured to engage the splines of a respective one of the two receivers of the shell, wherein the accessory panel is adapted to pivot between at least a first position and a second position, wherein the accessory panel rests against a back surface of the shell when in the first position, wherein the accessory panel functions as a stand for the shell and the installed portable electronic device to support the protective case and the installed portable electronic device in a viewing orientation when in the second position, and wherein the hubs and receivers are engaged in both the first position and the second position; and a device grip removably attached to the accessory panel, wherein the device grip is adapted to assist a user in holding the shell and the installed portable electronic device.

13. The protective case of claim 12 further comprising a lanyard removably attached to the shell, wherein the lanyard is adjustable in length.

14. The protective case of claim 12 wherein the accessory panel includes a storage location adapted for storing one or more of a credit card, a driver's license, and cash.

15. The protective case of claim 12 wherein the two flexible hinge arms are configured to flex toward each other to disengage the splines of the hubs and the receivers to enable the accessory panel to pivot between the first position and the second position.

16. The protective case of claim 12 wherein the second position is a portrait viewing orientation, wherein the accessory panel is further adapted to further pivot to a third position, and wherein the third position is a landscape viewing orientation.

17. The protective case of claim 12 wherein the accessory panel is temporarily held in the first position by a magnet.

* * * * *